US005722188A

United States Patent [19]

Ewing

[11] Patent Number: 5,722,188

[45] Date of Patent: Mar. 3, 1998

[54] SLUDGE DRYING BED SHOES

[76] Inventor: Ronald M. Ewing, 324 Washington St., Birdsboro, Pa. 19508

[21] Appl. No.: 701,638

[22] Filed: Aug. 22, 1996

[51] Int. Cl.[6] ..... A43B 5/04; A43B 5/16

[52] U.S. Cl. ..... 36/116; 36/122

[58] Field of Search ..... 36/116, 122, 123, 36/124, 125

[56] References Cited

U.S. PATENT DOCUMENTS

| | | | |
|---|---|---|---|
| 683,595 | 10/1901 | Drouillard | 36/116 |
| 1,014,482 | 1/1912 | Kaminski | 36/125 |
| 1,266,492 | 5/1918 | Helms et al. | 36/116 |
| 1,572,200 | 2/1926 | Fox | 36/122 |
| 1,630,041 | 5/1927 | Vose | 36/122 |
| 2,412,474 | 12/1946 | Paine et al. | 36/116 |
| 3,344,538 | 10/1967 | Massicotte | 36/125 |
| 3,555,707 | 1/1971 | Sharratt et al. | 36/123 |
| 3,861,698 | 1/1975 | Greig | 36/122 |
| 4,620,375 | 11/1986 | Wallace | 36/125 |
| 5,459,950 | 10/1995 | Damm et al. | 36/122 |

*Primary Examiner*—M. D. Patterson

[57] ABSTRACT

Sludge drying bed shoes comprise two shoe bases, each base being fabricated of ridged mesh including a plurality of perpendicularly intersecting rods; and two straps each having two free ends, each free end including coupling devices, one strap being coupled to each shoe base, the free ends of each strap being extendable over the upper surface of each shoe base to enable users to securely fasten the strap around their shoes, the apparatus enabling a user to walk upon the surface of sludge material.

1 Claim, 3 Drawing Sheets

SLUDGE DRYING BED SHOES

BACKGROUND OF THE INVENTION

1. Field of the Invention

The present invention relates to sludge drying bed shoes and more particularly pertains to enabling users to walk across sludge drying beds.

2. Description of the Prior Art

The use of shoe accessories is known in the prior art. More specifically, shoe accessories heretofore devised and utilized for the purpose of enabling users to traverse various surfaces are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,014,450 to McGrath discloses a snowshoe.

U.S. Pat. No. 4,348,823 to Knapp discloses snow life shoes.

U.S. Pat. No. Des. 272,936 to Klecker discloses a snowshoe.

U.S. Pat. No. 4,525,941 to Ruth, Jr. discloses a mud walker.

U.S. Pat. No. 5,309,652 to Campbell discloses a snow shoe kit.

U.S. Pat. No. 4,004,355 to Koblick discloses a shoe device and method of attaching a strap to a shoe member.

While these devices fulfill their respective, particular objective and requirements, the aforementioned patents do not describe sludge drying bed shoes for enabling users to walk across sludge drying beds.

In this respect, the sludge drying bed shoes according to the present invention substantially depart from the conventional concepts and designs of the prior art, and in doing so provides an apparatus primarily developed for the purpose of enabling users to walk across sludge drying beds.

Therefore, it can be appreciated that there exists a continuing need for new and improved sludge drying bed shoes which can be used for enabling users to walk across sludge drying beds. In this regard, the present invention substantially fulfills this need.

SUMMARY OF THE INVENTION

In the view of the foregoing disadvantages inherent in the known types of shoe accessories now present in the prior art, the present invention provides an improved sludge drying bed shoes. As such, the general purpose of the present invention, which will be described subsequently in greater detail, is to provide a new and improved sludge drying bed shoes and method which has all the advantages of the prior art and none of the disadvantages.

To attain this, the present invention essentially comprises a new and improved sludge drying bed shoes adapted for use in association with sludge drying beds, each sludge drying bed being filled with sludge in a semi-solid state, the apparatus comprising, in combination: two shoe bases each being formed in a planar generally rectangular configuration with a rounded front end, a linear rear end, two long side edges and an outer perimeter, each base being fabricated of ridged aluminum mesh including a plurality of perpendicularly intersecting rods, the width of the front end being about 50% greater than the width of the rear end; two frames each formed in a generally rectangular configuration with an upper surface, a lower surface, a hollow interior, a rounded front end, a linear rear end and two long side legs, the frames being coupled to the outer perimeter of each shoe base, each frame having a greater thickness than each base and including an upper surface, a central section and a lower surface, the central section of each frame having a recessed groove positioned therein, each base being affixed within a recessed groove; four support bars, two support bars being positioned across the long side legs of each frame, the support bars being positioned upon the upper surface of the frame in a parallel spaced orientation between the mid-point and front end of the frame; two shoe plates, each shoe plate being formed in a planar generally rectangular configuration with an upper surface and a lower surface, the lower surface of each shoe plate being affixed across the approximate center point of the support bars of each frame; and two straps each having two free ends, each free end including hook and loop coupling means, one strap being coupled to the lower surface of each shoe plate, the free ends of each strap being extendable over the upper surface of each shoe plate to enable users to securely fasten the strap around their shoes, the apparatus enabling a user to walk upon the surface of sludge material.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved sludge drying bed shoes which have all the advantages of the prior art shoe accessories and none of the disadvantages.

It is another object of the present invention to provide new and improved sludge drying bed shoes which may be easily and efficiently manufactured and marketed.

It is a further object of the present invention to provide new and improved sludge drying bed shoes which are of durable and reliable construction.

An even further object of the present invention is to provide new and improved sludge drying bed shoes which are susceptible of a low cost of manufacture with regard to both materials and labor, and which accordingly is then susceptible of low prices of sale to the consuming public, thereby making such sludge drying bed shoes economically available to the buying public.

Still yet another object of the present invention is to provide new and improved sludge drying bed shoes which provide in the apparatuses and methods of the prior art some of the advantages thereof, while simultaneously overcoming some of the disadvantages normally associated therewith.

Even still another object of the present invention is to provide new and improved sludge drying bed shoes for enabling users to walk across sludge drying beds.

Lastly, it is an object of the present invention to provide new and improved sludge drying bed shoes comprising two shoe bases, each base being fabricated of ridged mesh including a plurality of perpendicularly intersecting rods; and two straps each having two free ends, each free end including coupling devices, one strap being coupled to each shoe base, the free ends of each strap being extendable over the upper surface of each shoe base to enable users to securely fasten the strap around their shoes, the apparatus enabling a user to walk upon the surface of sludge material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
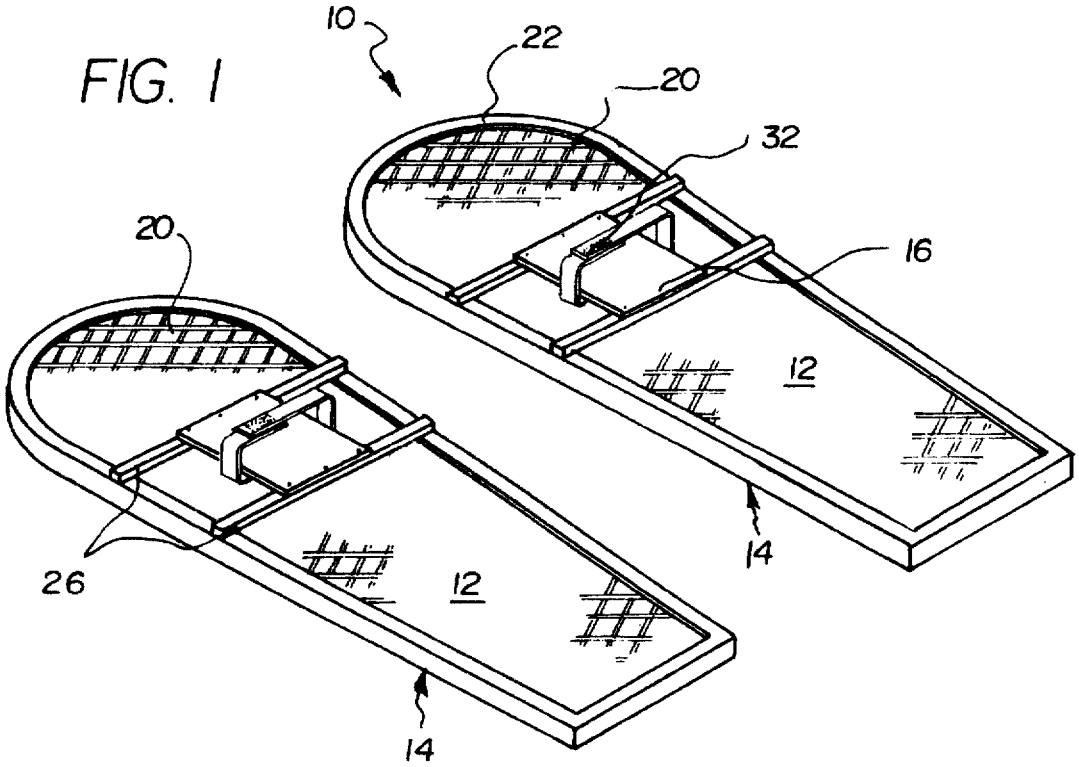
FIG. 1 is a perspective view of the preferred embodiment of the sludge drying bed shoes constructed in accordance with the principles of the present invention.

With reference now to the drawings, and in particular, to FIG. 1 thereof, the preferred embodiment of the new and improved sludge drying bed shoes embodying the principles and concepts of the present invention and generally designated by the reference number 10 will be described.

Specifically, it will be noted in the various Figures that the device relates to new and improved sludge drying bed shoes 10. In its broadest context, the device consists of shoe bases 12, two frames 14 and two shoe plates 16. Such components are individually configured and correlated with respect to each other so as to attain the desired objective.

The sludge drying bed shoes 10 are adapted for use in association with sludge drying beds. Each sludge drying bed is filled with sludge in a semi-solid state. Although drying beds vary in size, in the preferred embodiment applicant's drying bed is forty feet long, fifty feet wide and has a depth of at least two feet. Sludge is added to the beds three inches at a time. The beds are cleaned out when two feet of sludge has accumulated. The beds are filled with reeds, which are a swamp weed. The root structures of the reeds is such that they digest sludge material. The reeds die off annually and must be harvested to plant new reeds. A user must walk across the sludge to harvest the reeds. Additionally, the Environmental Protection Agency requires that samples of sludge be taken periodically. The apparatus is specifically designed to enable user to accomplish these objectives. Note FIG. 1.

Figure 2:
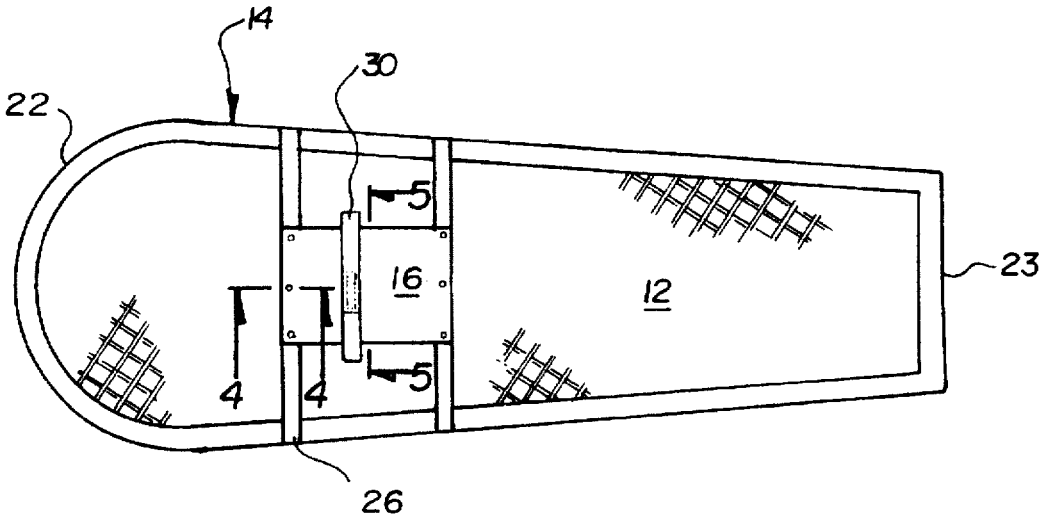
FIG. 2 is a top perspective view of a sludge shoe.
Figure 3:
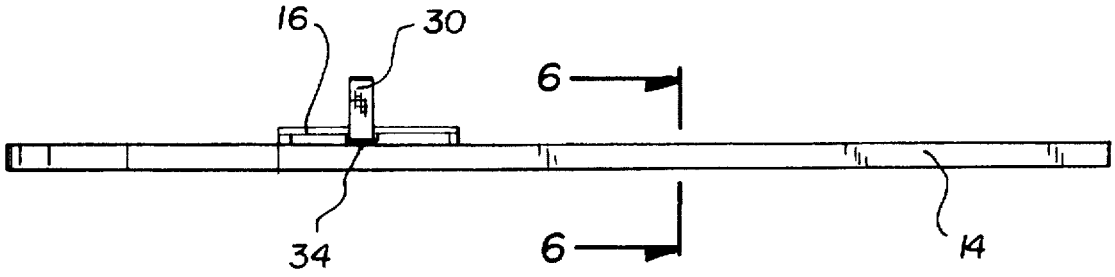
FIG. 3 is a side elevational view of a sludge shoe.

Two shoe bases 12 are each formed in a planar generally rectangular configuration with a rounded front end, a linear rear end, two long side edges and an outer perimeter. Each base is fabricated of ridged aluminum mesh and includes a plurality of perpendicularly intersecting rods 20. The width of the front end of each shoe base is about 50% greater than the width of the rear end. Note FIGS. 1 and 2.

Figure 6:
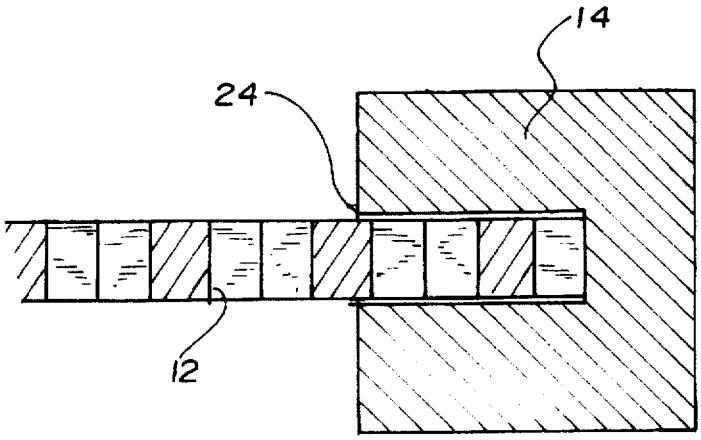
FIG. 6 is a cross sectional view of the base and frame of a shoe taken along section line 6—6 of FIG. 3.

Two frames 14 are each formed in a generally rectangular configuration with an upper surface, a lower surface, a hollow interior, a rounded front end 22, a linear rear end 23 and two long side less. In the preferred embodiment of the apparatus, the frame is fabricated of aluminum and has a height os 26½ inches, a front width of 11½ inches and a rear width of 8 inches. Each frame has a similar shape to the shoe bases. The frames are coupled to the outer perimeter of each shoe base. Each frame has a greater thickness than each shoe base and includes an upper surface, a central section and a lower surface. The central section of each frame has a recessed 24 groove that extends around the entire frame. Each base is affixed within a recessed groove. Note FIGS. 1 and 6.

Four support bars 26 are included with the apparatus. Two support bars are positioned across the long side legs of each frame. The support bars are positioned upon the upper surface of the frame in a parallel spaced orientation between the mid-point and front end of the frame. Note FIG. 2.

Figure 4:
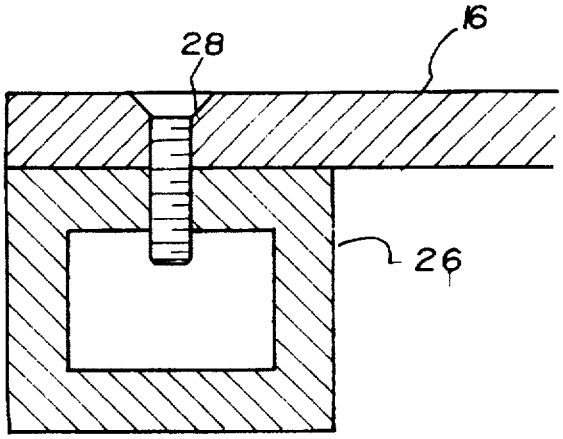
FIG. 4 is a cross sectional view of a shoe plate and support bar taken along section line 4—4 of FIG. 2.
Figure 5:
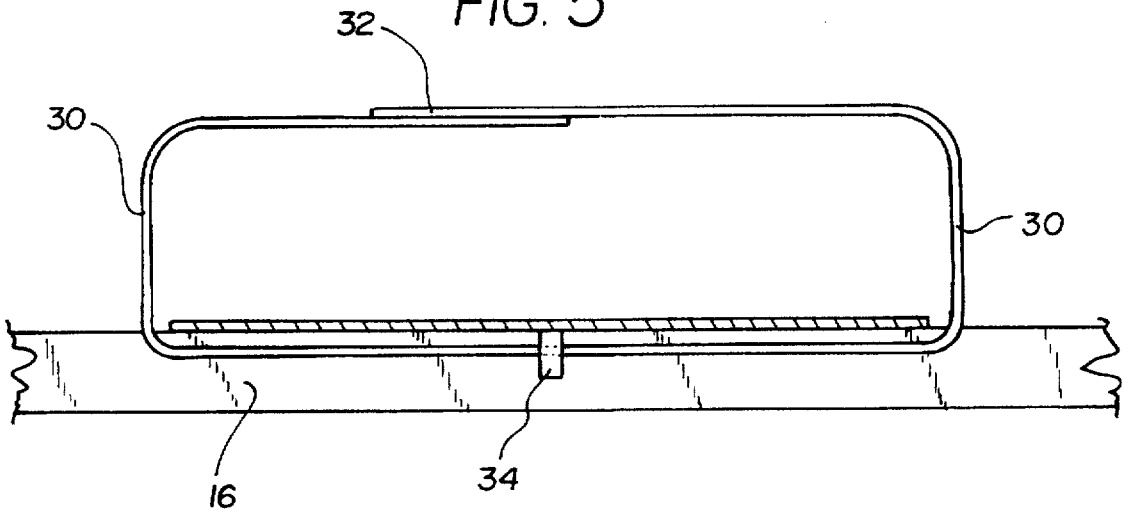
FIG. 5 is a perspective view of a shoe plate taken along section line 5—5 of FIG. 2.

Two shoe plates 16 are also included with the apparatus. Each shoe plate is formed in a planar generally rectangular configuration with an upper surface and a lower surface. Each shoe plate has a height of about 8 inches and a width of about 5 inches. The lower surface of each shoe plate is affixed across the approximate center point of the support bars of each frame by a bolt 28. Note FIGS. 2, 4 and 5.

Two straps 30 each have two free ends. Each free end includes hook and loop coupling means 32. In the preferred embodiment Velcro hook and loop coupling means are utilized. One strap is coupled by a loop 34 to the lower surface of each shoe plate. The free ends of each strap are extendable over the upper surface of each shoe plate to enable users to securely fasten the strap around their shoes. The apparatus enables a user to walk upon the surface of sludge material. Note FIGS. 1 and 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. New and improved sludge drying bed shoes adapted for use in association with sludge drying beds, each sludge drying bed being filled with sludge in a semi-solid state, the apparatus comprising, in combination:

two shoe bases each being formed in a plenary generally rectangular configuration with a rounded front end, a linear rear end, two long side edges and an outer perimeter, each base being fabricated of rigid aluminum mesh including a plurality of perpendicularly intersecting rods, the width of the front end being about 50% grater than the width of the rear end;

two frames each formed in a generally rectangular configuration with an upper surface, a lower surface, a hollow interior, a rounded front end, a linear rear end and two long side leges, the frame has a height of 26½ inches, a front width of 11½ inches and a rear width of 8 inches, the frames being coupled to the outer perimeter of each shoe base, each frame having a greater thickness than each base and including an upper surface, a central section and a lower surface, the central section of each frame having a recessed groove extending therearound, each base being affixed within a recessed groove;

four support bars, two support bars being positioned across the long side legs of each frame, the support bars being positioned upon the upper surface of the frame in a parallel spaced orientation between the mid-point and front end of the frame;

two shoe plates, each shoe plate being formed in a planar generally rectangular configuration with an upper surface and a lower surface, each shoe plate having a height of about 8 inches and a width of about 5 inches, the lower surface of each shoe plate is affixed across the approximate center point of the support bars of each frame by a bolt; and two straps each having two free ends, each free end including hook and loop coupling means, one strap being coupled to the lower surface of each shoe plate, the free ends of each strap being extendable over the upper surface of each shoe plate to enable users to securely fasten the strap around their shoes, the apparatus enabling a user to walk upon the surface of sludge material.

* * * * *